US006415690B1

(12) United States Patent
Yang

(10) Patent No.: US 6,415,690 B1
(45) Date of Patent: Jul. 9, 2002

(54) SPANNER

(76) Inventor: Chung-Jeng Yang, 58, Ma Yuan West St., Taichung (TW)

( * ) Notice: Subject to any disclaimer, the term of this patent is extended or adjusted under 35 U.S.C. 154(b) by 0 days.

(21) Appl. No.: 10/010,060

(22) Filed: Nov. 8, 2001

(51) Int. Cl.[7] ..... B25B 13/46
(52) U.S. Cl. ..... 81/63; 81/60; 81/465
(58) Field of Search ..... 81/60, 61, 62, 81/63, 63.1, 63.2, 463, 465, 466

(56) References Cited

U.S. PATENT DOCUMENTS

| | | | | | |
|---|---|---|---|---|---|
| 1,295,072 | A | * | 2/1919 | Schanno | 81/463 |
| 1,578,065 | A | * | 3/1926 | Bemus et al. | 81/61 |
| 1,675,729 | A | * | 7/1928 | Reynolds | 81/465 |
| 2,972,919 | A | * | 2/1961 | Stalkup | 81/63 |
| 3,839,929 | A | * | 10/1974 | Richards | 81/177.2 |
| 6,345,559 | B1 | * | 2/2002 | Wang | 81/466 |

* cited by examiner

*Primary Examiner*—James G. Smith
*Assistant Examiner*—Hadi Shakeri

(57) ABSTRACT

A spanner has a handle, a head frame connected to the handle, a drive head device, a pair of reinforced plates, and a pair of arm plates. The head frame has a pair of parallel panels, and a spacing formed between the parallel panels. Each parallel panel has a first pivot hole, a second pivot hole, and a third pivot hole. The reinforced plates and the arm plates are inserted in the spacing of the head frame. Each arm plate has a square hole and a round hole. Each reinforced plate has a round aperture and a circular aperture. The drive head device has a round head. The round head of the drive head device passes through the first pivot hole of each panel and the square hole of each arm plate. A gasket is disposed on one of the panels. A bolt passes through the gasket to be engaged with the round head of the drive head device. A first pin fastens each panel, each reinforced plate, and each arm plate pivotally. A second pin fastens each panel and each reinforced plate pivotally.

3 Claims, 10 Drawing Sheets

SPANNER

BACKGROUND OF THE INVENTION

The present invention relates to a spanner. More particularly, the present invention relates to a spanner which is operated easily.

A conventional spanner has a handle and a head connected to the handle. However, a user should use a large force of a hand in order to operate the conventional spanner.

SUMMARY OF THE INVENTION

An object of the present invention is to provide a spanner which is operated easily in order to facilitate a user to save a force of a hand while operating the spanner.

Accordingly, a spanner comprises a handle, a head frame connected to the handle, a drive head device, a pair of reinforced plates, and a pair of arm plates. The head frame has a pair of parallel panels, and a spacing formed between the parallel panels. Each parallel panel has a first pivot hole, a second pivot hole, and a third pivot hole. The reinforced plates and the arm plates are inserted in the spacing of the head frame. Each arm plate has a square hole and a round hole. Each reinforced plate has a round aperture and a circular aperture. The drive head device has a round head. The round head of the drive head device passes through the first pivot hole of each panel and the square hole of each arm plate. A gasket is disposed on one of the panels. A bolt passes through the gasket to be engaged with the round head of the drive head device. A first pin passes through the third pivot hole of each panel, the circular aperture of each reinforced plate, and the round hole of each arm plate to fasten each panel, each reinforced plate, and each arm plate pivotally. A second pin passes through the second pivot hole of each panel and the round aperture of each reinforced plate to fasten each panel and each reinforced plate pivotally.

DETAILED DESCRIPTION OF THE INVENTION

Figure 1:
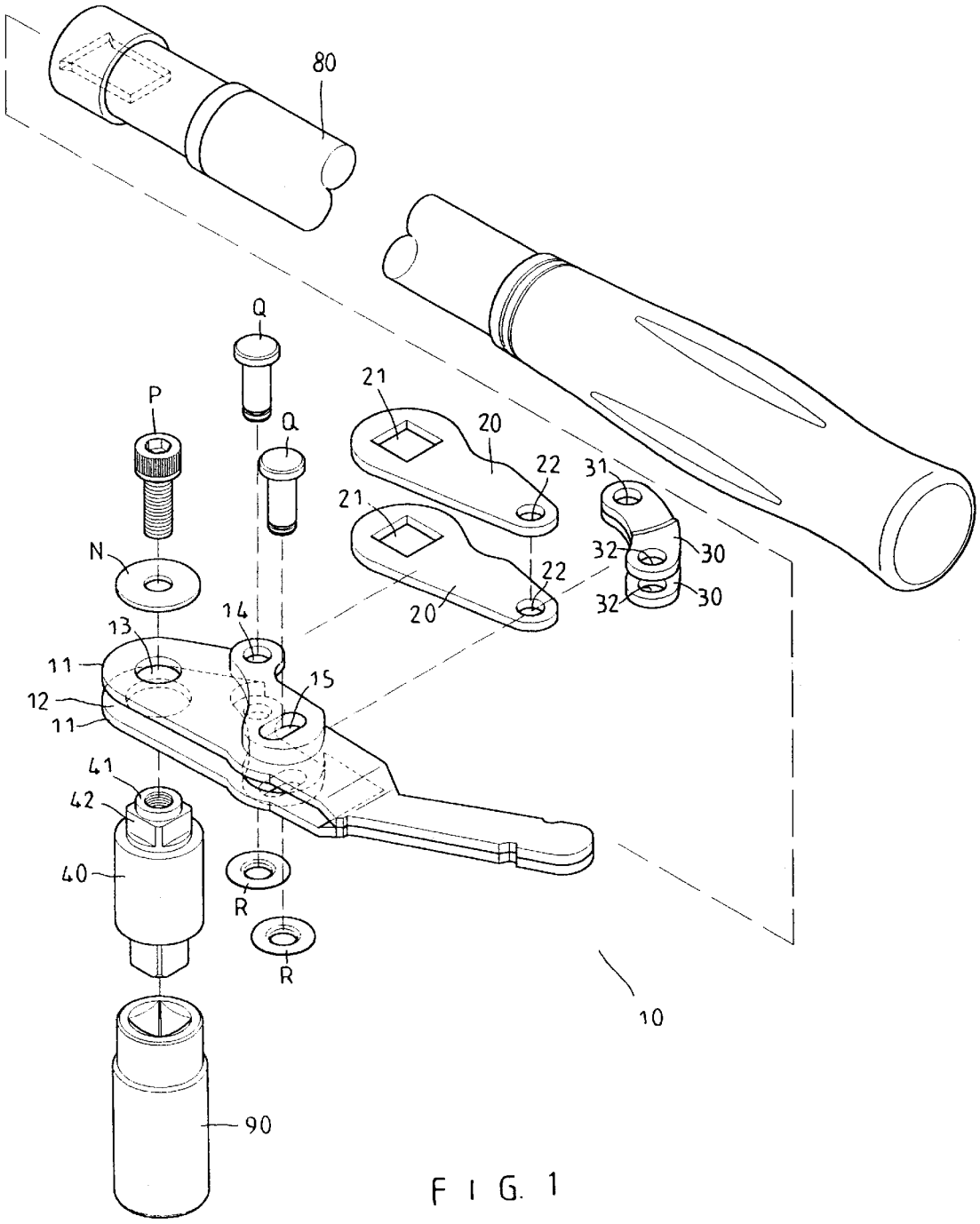
FIG. 1 is a perspective exploded view of a spanner of a first preferred embodiment in accordance with the present invention.
Figure 2:
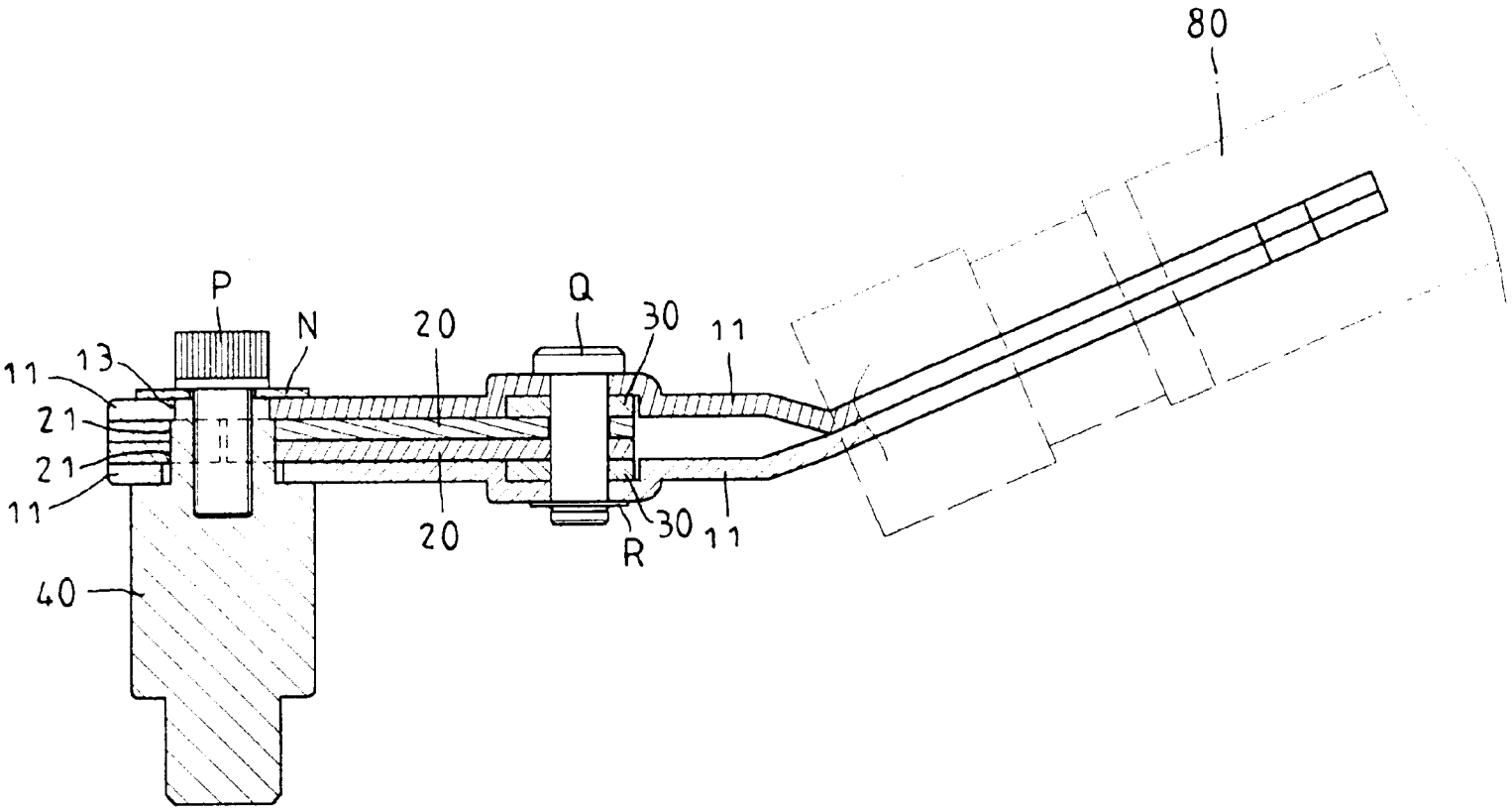
FIG. 2 is a sectional assembly view of a spanner of a first preferred embodiment in accordance with the present invention.
Figure 3:
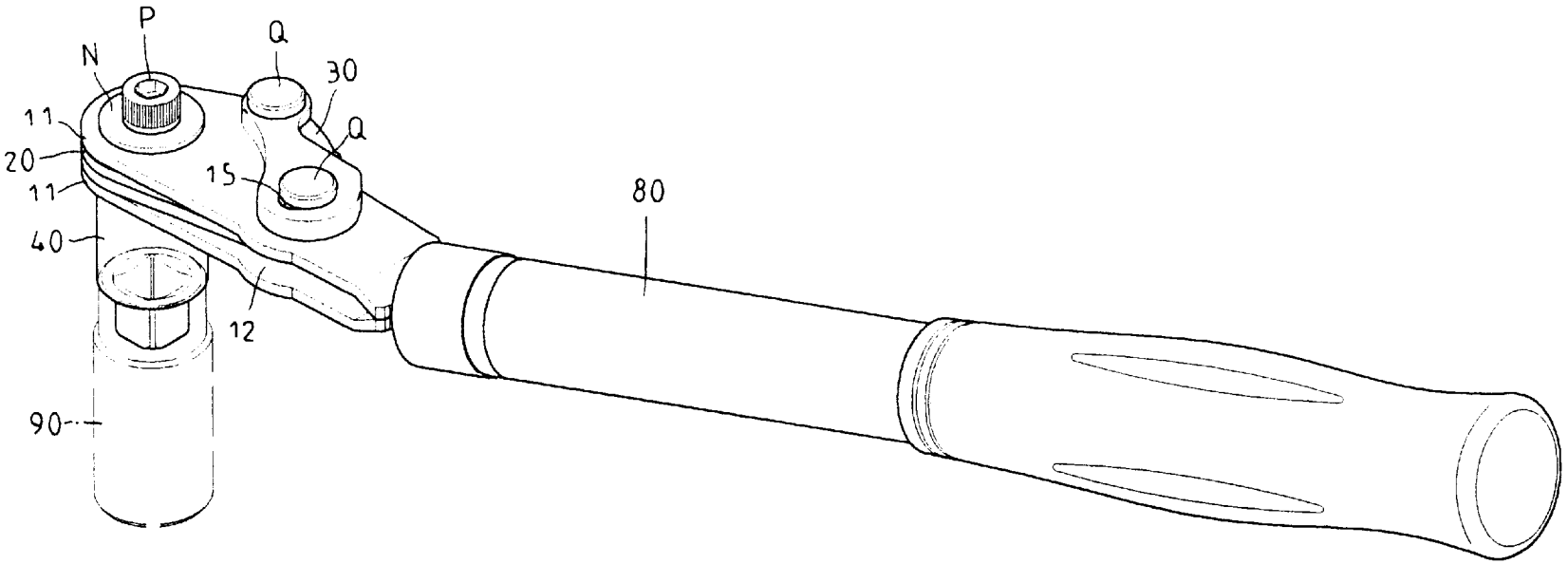
FIG. 3 is a perspective assembly view of a spanner of a first preferred embodiment in accordance with the present invention.
Figure 4:
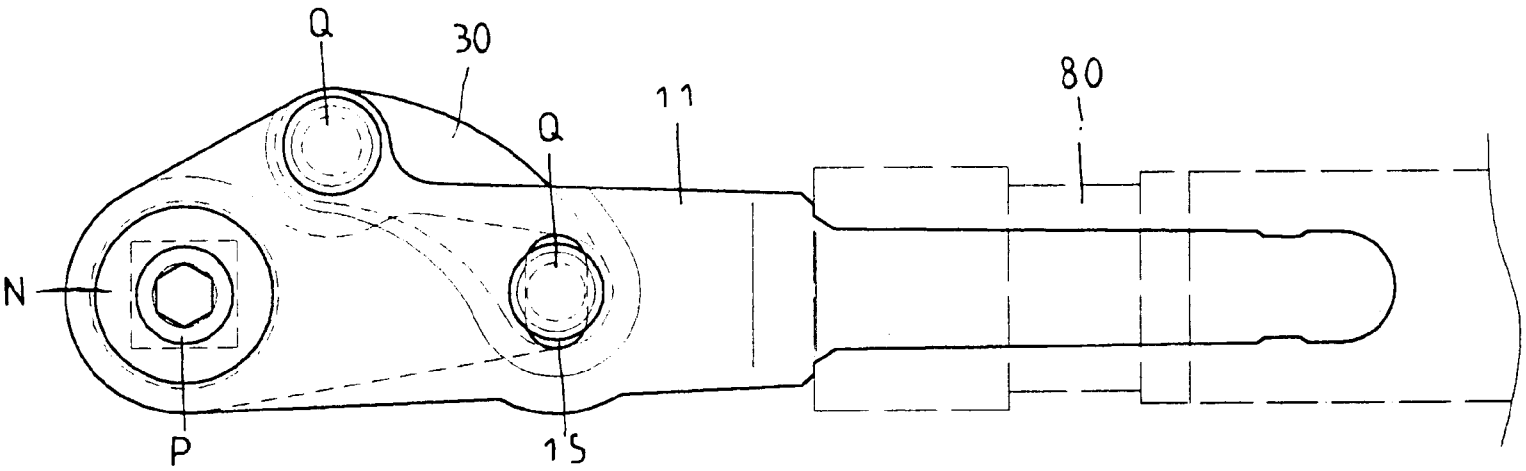
FIG. 4 is a schematic view illustrating an operation of a spanner of a first preferred embodiment in accordance with the present invention.
Figure 5:
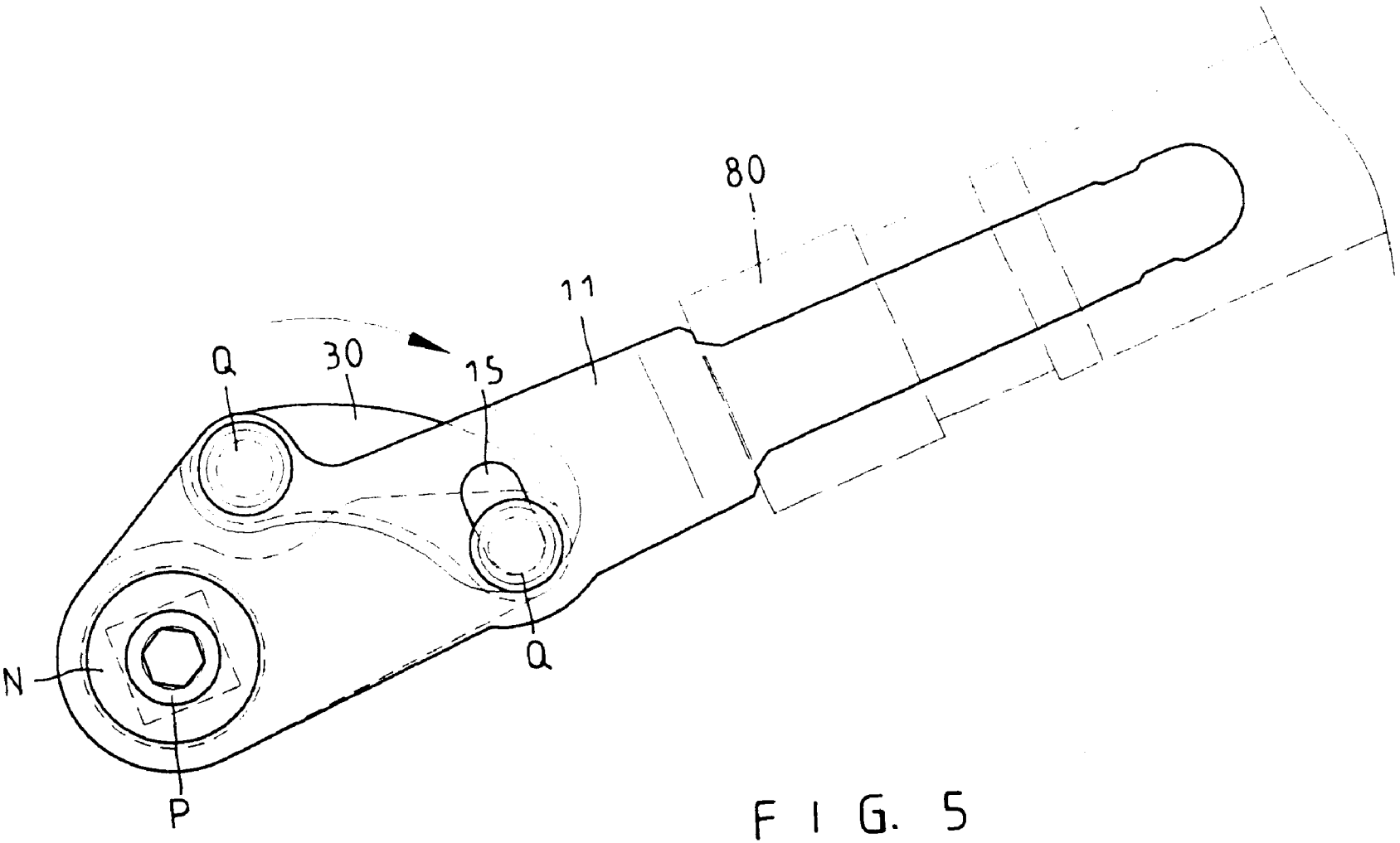
FIG. 5 is a schematic view illustrating another operation of a spanner of a first preferred embodiment in accordance with the present invention.

Referring to FIGS. 1 to 5, a first spanner 10 comprises a handle 80, a head frame 101 connected to the handle 80, a drive head device 40, a pair of reinforced plates 30, and a pair of arm plates 20.

The head frame 101 has a pair of parallel panels 11, and a s pacing 12 formed between the parallel panels 11.

Each of the parallel panels 11 has a first pivot hole 13, a second pivot hole 14, and a third pivot hole 15.

The reinforced plates 30 and the arm plates 20 are inserted in the spacing 12 of the head frame 101.

Each of the arm plates 20 has a square hole 21 and a round hole 22.

Each of the reinforced plates 30 has a round aperture 31 and a circular aperture 32.

The drive head device 40 has a round head 41 and a square neck 42.

The round head 41 of the drive head device 40 passes through the first pivot hole 13 of each panel 11 and the square hole 21 of each arm plate 20.

A gasket N is disposed on one of the panels 11.

A bolt P passes through the gasket N to be engaged with the round head 41 of the drive head device 40.

A first pin Q passes through the third pivot hole 15 of each panel 11, the circular aperture 32 of each reinforced plate 30, and the round hole 22 of each arm plate 20 to fasten each panel 11, each reinforced plate 30, and each arm plate 20 pivotally.

A first washer R engages with the first pin Q.

A second pin Q passes through the second pivot hole 14 of each panel 11 and the round aperture 31 of each reinforced plate 30 to fasten each panel 11 and each reinforced plate 30 pivotally.

A second washer R engages with the second pin Q.

The third pivot hole 15 of each panel 11 has an oblong shape.

A sleeve 90 engages with the drive head device 40.

When the first spanner 10 is operated, the reinforced plate 30 is moved along the third pivot hole 15 of each panel 11. Then each of the arm plates 20 provides a lever motion to drive the drive head device 40.

Figure 6:
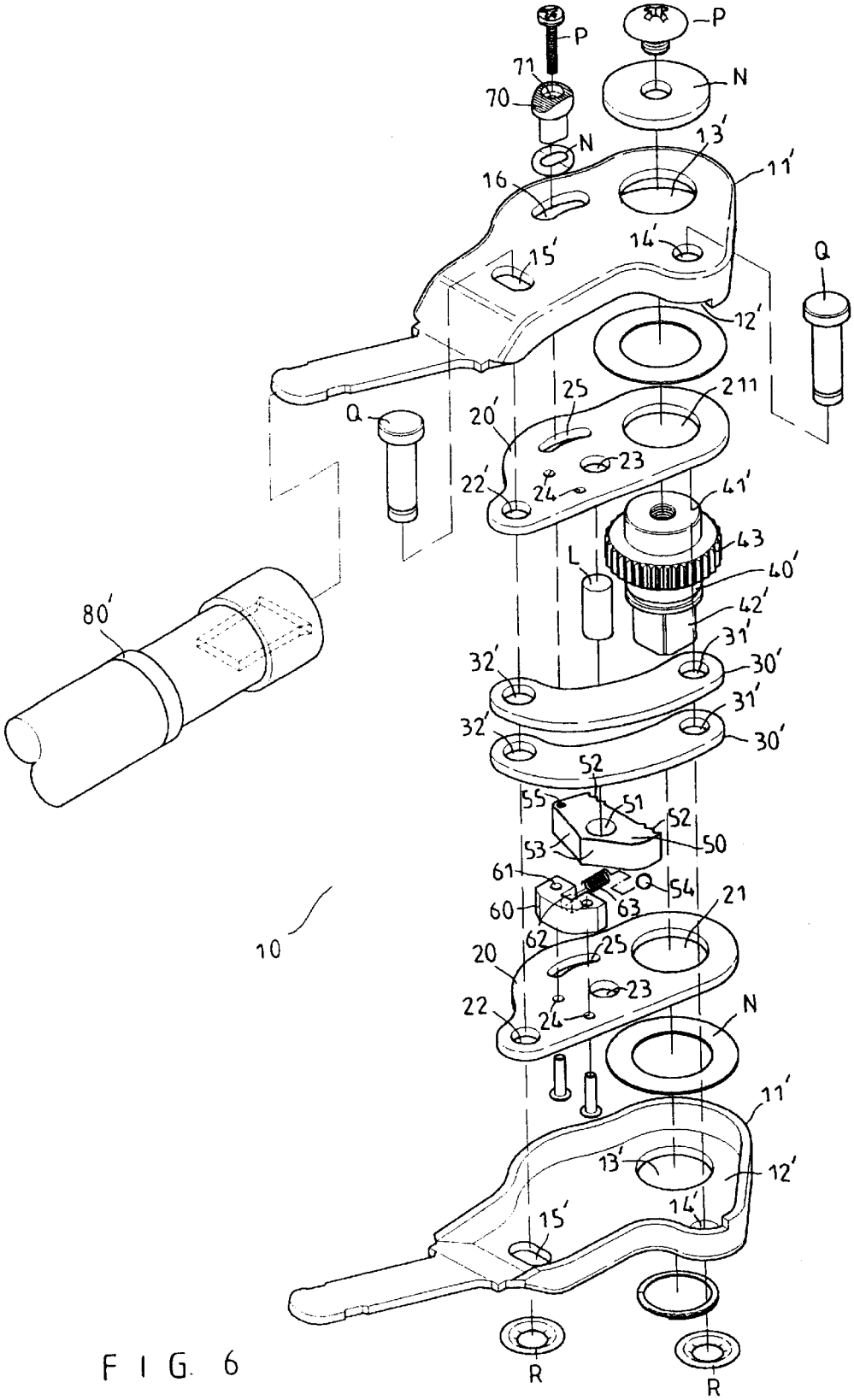
FIG. 6 is a perspective exploded view of a spanner of a second preferred embodiment in accordance with the present invention.
Figure 7:
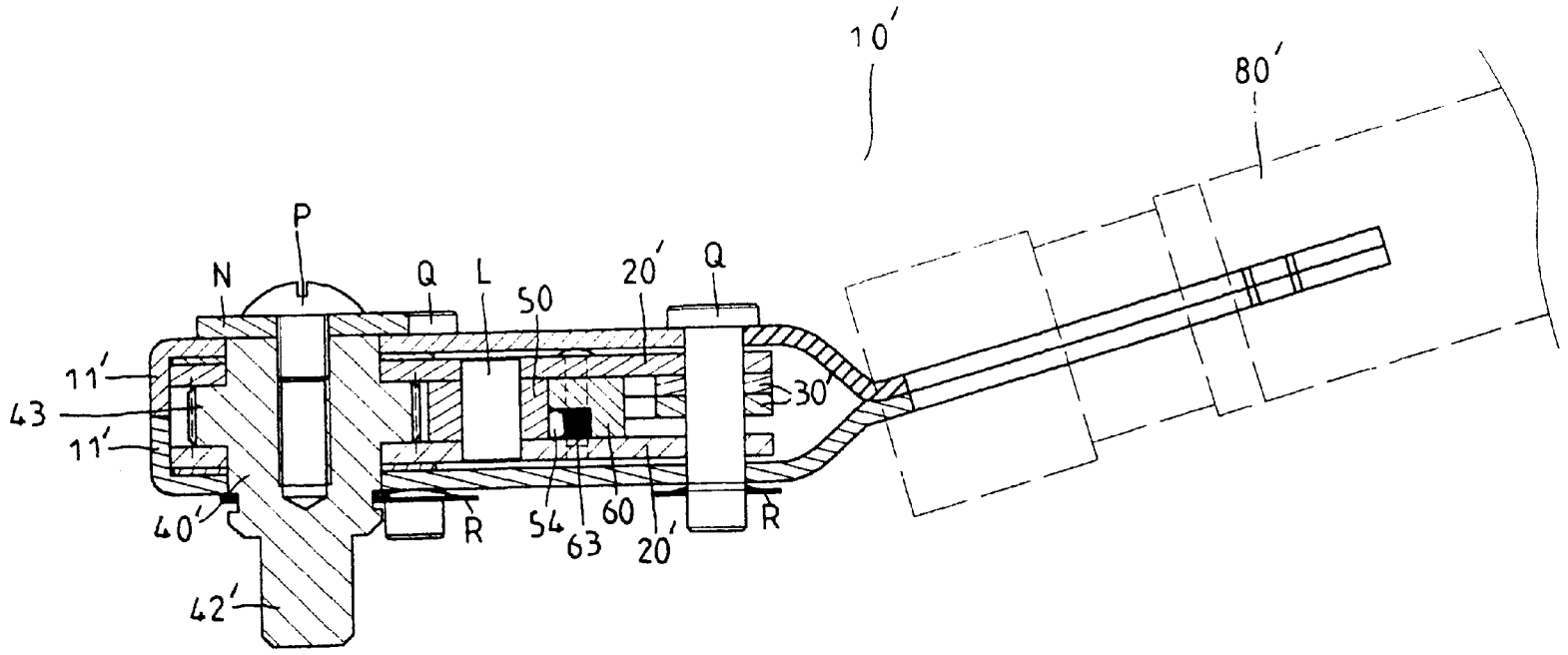
FIG. 7 is a sectional assembly view of a spanner of a second preferred embodiment in accordance with the present invention.
Figure 8:
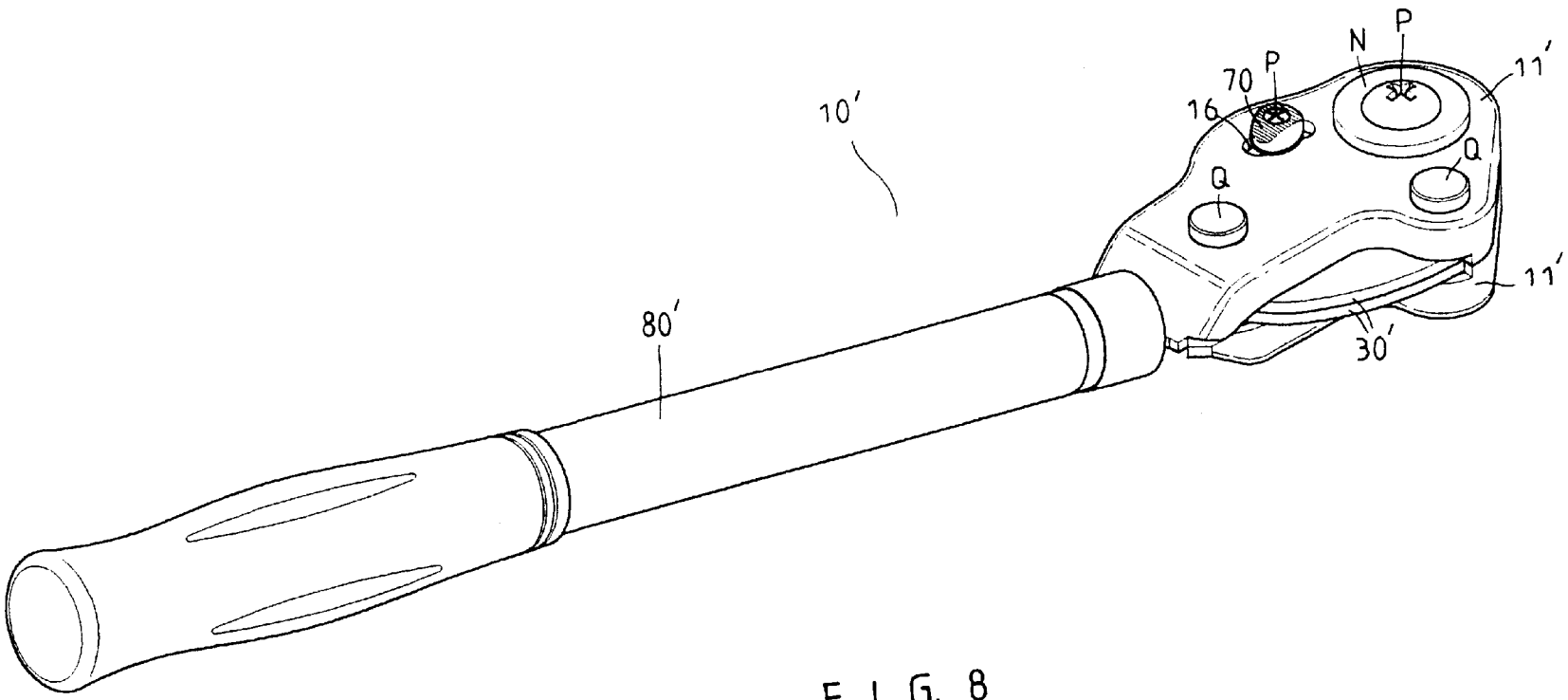
FIG. 8 is a perspective assembly view of a spanner of a second preferred embodiment in accordance with the present invention.
Figure 9:
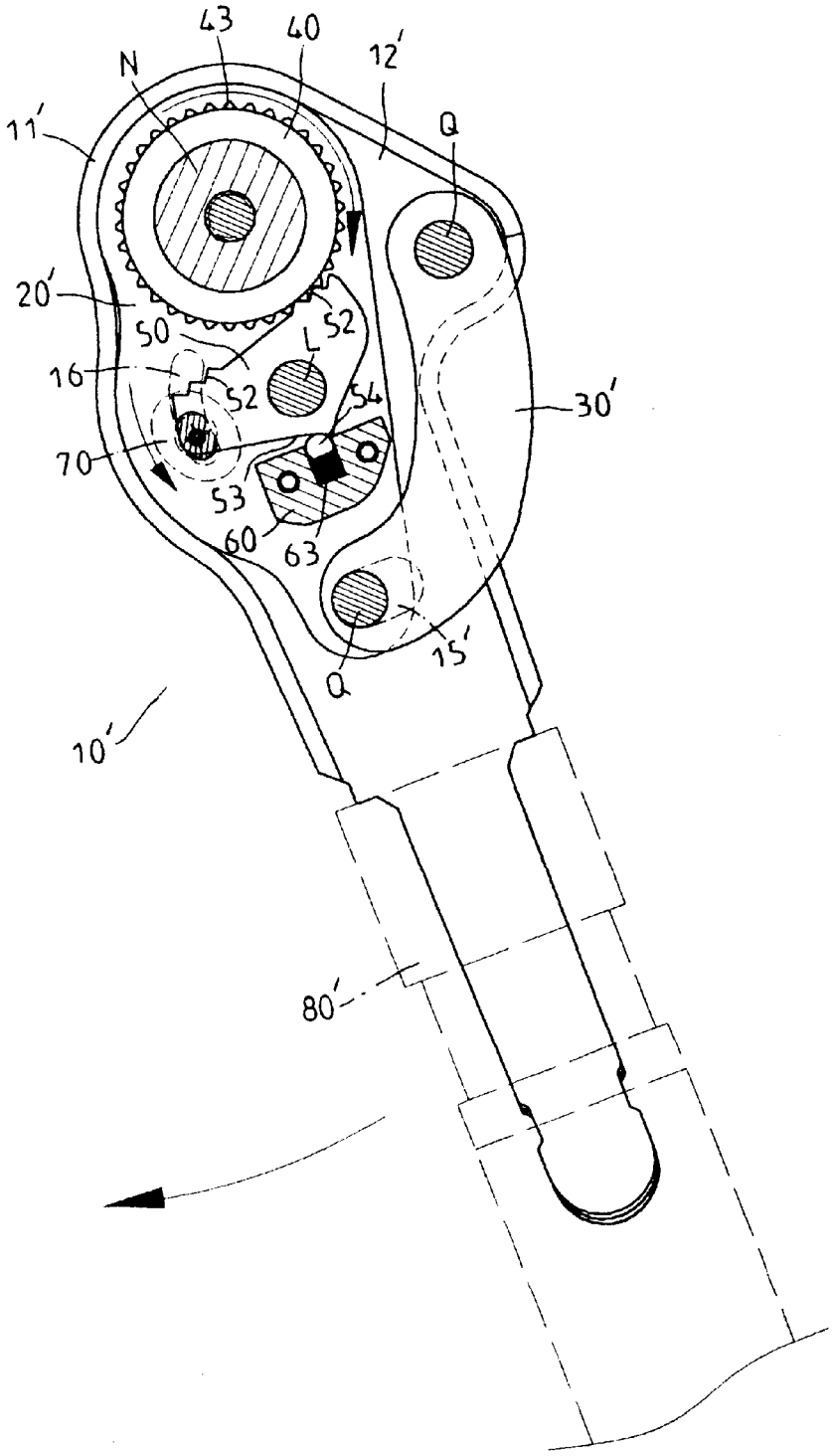
FIG. 9 is a schematic view illustrating an operation of a spanner of a second preferred embodiment in accordance with the present invention.
Figure 10:
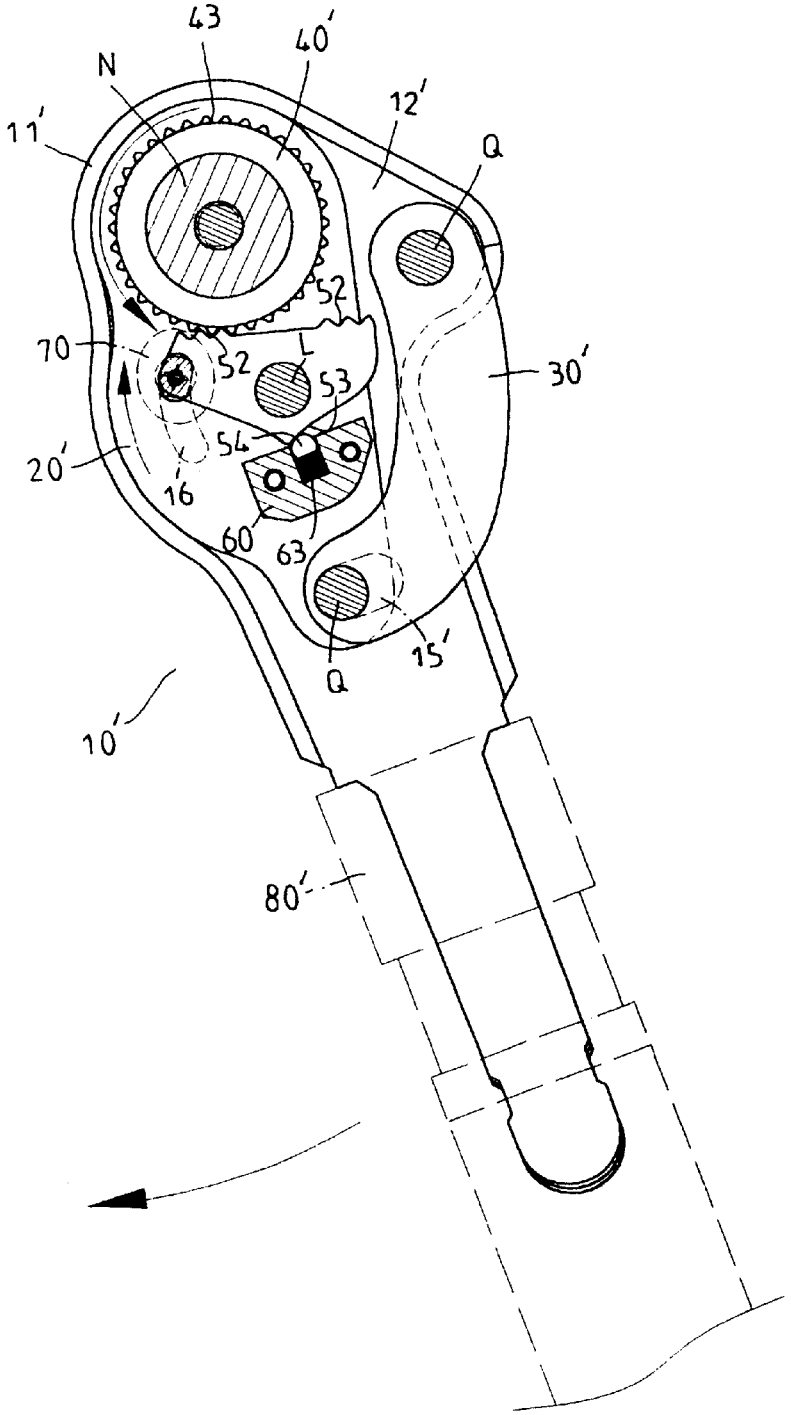
FIG. 10 is a schematic view illustrating another operation of a spanner of a second preferred embodiment in accordance with the present invention.

Referring to FIGS. 6 to 10, a second spanner 10' comprises a handle 80', a pair of head frames 11' connected to the handle 80', a drive head device 40', a pair of reinforced plates 30', a pair of arm plates 20', a serrated block 50, a ball 54, a stud L, a spring seat 60, and a spring 63.

Each of the head frames 11' has a hollow interior 12', a first pivot hole 13', a second pivot hole 14', a third pivot hole 15', and an oblong hole 16.

The reinforced plates 30', the arm plates 20', the serrated block 50, and the spring seat 60 are disposed in the hollow interior 12' of each head frame 11'.

Each of the arm plates 20' has a circular hole 21', a round hole 22', a pivot aperture 23', a plurality of through apertures 24', and an oblong aperture 25'.

Each of the reinforced plates 30' has a round aperture 31' and a circular aperture 32'.

The drive head device 40' has a round head 41', a ratchet wheel 43', and a lower block 42'.

The serrated block 50 has a pair of adjacent curved faces 53, a threaded aperture 55, a center hole 51, and two sets of teeth 52.

The spring seat 60 has a plurality of through holes 61, and a groove 62 to receive the spring 63.

The serrated block 50 and the reinforced plates 30' are disposed between the arm plates 20'.

The stud L passes through the pivot aperture 23' of each arm plate 20' and the center hole 51 of the serrated block 50.

The ball 54 is disposed on the spring 63.

The ball 54 contacts one of the curved faces 53 of the serrated block 50.

Two rivets T pass through the through apertures 24' of each arm plate 20' and the through holes 61 of the spring seat 60.

The round head 41' of the drive head device 40' passes through the circular hole 21' of one of the arm plates 20' and the first pivot hole 13' of one of the head frames 11'.

A bolt P passes through a gasket N to be engaged with the round head 41' of the drive head device 40'.

The lower block 42' of the drive head device 40' passes through the circular hole 21' of the other arm plate 20', another gasket N, and the first pivot hole 13' of the other head frame 11'.

An adjustment button 70 passes through a third gasket N.

The adjustment button 70 has a threaded hole 71.

Another bolt P passes through the threaded hole 71 of the adjustment button 70, the oblong hole 16 of each head frame 11', the oblong aperture 25' of each arm plate 20', and the threaded aperture 55 of the serrated block 50.

A first pin Q passes through the third pivot hole 15' of each head frame 11', the circular aperture 32' of each reinforced plate 30', and the round hole 22' of each arm plate 20' to fasten each head frame 11', each reinforced plate 30', and each arm plate 20' pivotally.

A first washer R engages with the first pin Q.

A second pin Q passes through the second pivot hole 14' of each head frame 11' and the round aperture 31' of each reinforced plate 30' to fasten each head frame 11' and each reinforced plate 30' pivotally.

A second washer R engages with the second pin Q.

One set of the teeth 52 engages with the ratchet wheel 43'.

The lower block 42' has a square shape.

The adjustment button 70 is moved by a user. Then the other set of the teeth 52 engages with the ratchel wheel 43'. When the second spanner 10' is operated, the reinforced plate 30' is moved along the third pivot hole 15' of each head frame 11'. Then each of the arm plates 20' provides a lever motion to drive the drive head device 40'.

The invention is not limited to the above embodiment but various modification thereof may be made. Further, various changes in form and detail may be made without departing from the scope of the invention.

I claim:

1. A spanner comprises:

a handle, a head frame connected to the handle, a drive head device, a pair of reinforced plates, and a pair of arm plates, the head frame having a pair of parallel panels, and a spacing formed between the parallel panels, each said parallel panel having a first pivot hole, a second pivot hole, and a third pivot hole, the reinforced plates and the arm plates inserted in the spacing of the head frame, each said arm plate having a square hole and a round hole, each said reinforced plate having a round aperture and a circular aperture, the drive head device having a round head, the round head of the drive head device passing through the first pivot hole of each said panel and the square hole of each said arm plate, a gasket disposed on one of the panels, a bolt passing through the gasket to be engaged with the round head of the drive head device, a first pin passing through the third pivot hole of each said panel, the circular aperture of each said reinforced plate, and the round hole of each said arm plate to fasten each said panel, each said reinforced plate, and each said arm plate pivotally, and a second pin passing through the second pivot hole of each said panel and the round aperture of each said reinforced plate to fasten each said panel and each said reinforced plate pivotally.

2. A spanner comprises:

a handle, a pair of head frames connected to the handle, a drive head device, a pair of reinforced plates, a pair of arm plates, a serrated block, a ball, a stud, a spring seat, and a spring, each said head frame having a hollow interior, a first pivot hole, a second pivot hole, a third pivot hole, and an oblong hole, the reinforced plates, the arm plates, the serrated block, and the spring seat disposed in the hollow interior of each said head frame, each said arm plate having a circular hole, a round hole, a pivot aperture, a plurality of through apertures, and an oblong aperture, each said reinforced plate having a round aperture and a circular aperture, the drive head device having a round head, a ratchet wheel, and a lower block, the serrated block having a pair of adjacent curved faces, a threaded aperture, a center hole, and two sets of teeth, the spring seat having a plurality of through holes, and a groove to receive the spring, the serrated block and the reinforced plates disposed between the arm plates, the stud passing through the pivot aperture of each said arm plate and the center hole of the serrated block, the ball disposed on the spring, the ball contacting one of the curved faces of the serrated block, two rivets passing through the through apertures of each said arm plate and the through holes of the spring seat, the round head of the drive head device passing through the circular hole of one of the arm plates and the first pivot hole of one of the head frames, a bolt passing through a first gasket to be engaged with the round head of the drive head device, the lower block of the drive head device passing through the circular hole of the other arm plate, a second gasket, and the first pivot hole of the other head frame, an adjustment button passing through a third gasket, the adjustment button having a threaded hole, another bolt passing through the threaded hole of the adjustment button, the oblong hole of each said head frame, the oblong aperture of each said arm plate, and the threaded aperture of the serrated block, a first pin passing through the third pivot hole of each said head frame, the circular aperture of each said reinforced plate, and the round hole of each said arm plate to fasten each said head frame, each said reinforced plate, and each said arm plate pivotally, a second pin passing through the second pivot hole of each said head frame and the round aperture of each said reinforced plate to fasten each said head frame and each said reinforced plate pivotally, and one set of the teeth engaging with the ratchet wheel.

3. The spanner as claimed in claim 2, wherein the lower block has a square shape.

* * * * *